US012791261B2

(12) United States Patent
Fujita et al.

(10) Patent No.: US 12,791,261 B2
(45) Date of Patent: Nov. 10, 2026

(54) HEAT EXCHANGE SYSTEM

(71) Applicant: Sumitomo Precision Products Co., Ltd., Amagasaki (JP)

(72) Inventors: Yasuhiro Fujita, Amagasaki (JP); Munehisa Yamakoshi, Amagasaki (JP)

(73) Assignee: Sumitomo Precision Products Co., Ltd., Amagasaki (JP)

( * ) Notice: Subject to any disclaimer, the term of this patent is extended or adjusted under 35 U.S.C. 154(b) by 118 days.

(21) Appl. No.: 18/899,698

(22) Filed: Sep. 27, 2024

(65) Prior Publication Data

US 2025/0020412 A1 Jan. 16, 2025

Related U.S. Application Data

(63) Continuation of application No. PCT/JP2023/013369, filed on Mar. 30, 2023.

(30) Foreign Application Priority Data

Mar. 31, 2022 (JP) ..... 2022-058692

(51) Int. Cl.
*F28D 9/00* (2006.01)

(52) U.S. Cl.
CPC ..... *F28D 9/0093* (2013.01)

(58) Field of Classification Search
CPC ..... F17C 2205/0326; F17C 2205/0329; F17C 2221/012; F17C 2221/017;
(Continued)

(56) References Cited

U.S. PATENT DOCUMENTS 3,552,134 A 1/1971 Arenson
2010/0181053 A1 7/2010 Hecht et al.
(Continued)

FOREIGN PATENT DOCUMENTS

EP 0 470 532 A1 2/1992
EP 0470532 B1 * 1/1994 ..... F17C 9/02
(Continued)

OTHER PUBLICATIONS

International Search Report (PCT/ISA/210) issued in PCT Application No. PCT/JP2023/013369 dated Jun. 20, 2023 with English translation (5 pages).
(Continued)

*Primary Examiner* — Nelson J Nieves
(74) *Attorney, Agent, or Firm* — Crowell & Moring LLP

(57) ABSTRACT

A heat exchange system (100) according to this invention includes a first heat exchanger (3) for transferring heat between a low-temperature fluid (80) and a high-temperature fluid (81); a second heat exchanger (4) for transferring heat between flows of the low-temperature fluid; and a heater, the second heat exchanger including a first inlet (4*a*) configured for the low-temperature fluid to flow into, a first outlet which communicates with the first inlet, a second inlet (4*c*) configured for the low-temperature fluid to flow into, and a second outlet (4*d*) which communicates with the second inlet, the heater being configured to heat the low-temperature fluid flowing out from the first outlet, the low-temperature fluid flowing out from the second outlet can flow into the first exchanger.

8 Claims, 6 Drawing Sheets

(58) Field of Classification Search
CPC ..... F17C 2221/033; F17C 2225/0123; F17C 2225/036; F17C 2227/0306; F17C 2227/0309; F17C 2227/0316; F17C 2227/0323; F17C 2227/0393; F17C 2265/05; F17C 2265/065; F17C 2270/0139; F28D 9/0093; F28D 2021/0033; F28F 27/02
See application file for complete search history.

(56) References Cited

U.S. PATENT DOCUMENTS

| | | | | |
|---|---|---|---|---|
| 2021/0164734 | A1* | 6/2021 | Haik-Beraud | F25J 1/0214 |
| 2022/0236017 | A1* | 7/2022 | Benouali | H01M 10/625 |
| 2022/0275997 | A1* | 9/2022 | Haik-Beraud | F28D 9/0062 |
| 2023/0193880 | A1* | 6/2023 | Wang | F03D 80/60 165/300 |
| 2024/0003635 | A1* | 1/2024 | Greiciunas | F28D 1/03 |
| 2024/0230033 | A1* | 7/2024 | Lee | B63B 17/0036 |
| 2024/0410648 | A1* | 12/2024 | Kim | F25J 1/005 |

FOREIGN PATENT DOCUMENTS

| | | | |
|---|---|---|---|
| JP | 49-15921 | B1 | 4/1974 |
| JP | 6-279773 | A | 10/1994 |
| JP | 2004-99717 | A | 4/2004 |
| JP | 2010-101617 | A | 5/2010 |
| JP | 2010-208913 | A | 9/2010 |
| JP | 2012-246981 | A | 12/2012 |
| KR | 20-0493619 | Y1 | 5/2021 |

OTHER PUBLICATIONS

Japanese-language Written Opinion (PCT/ISA/237) issued in PCT Application No. PCT/JP2023/013369 dated Jun. 20, 2023 with English translation (7 pages).

* cited by examiner

HEAT EXCHANGE SYSTEM

BACKGROUND OF THE INVENTION

Technical Field

The present invention relates to a heat exchange system, in particular to a heat exchange system for transferring heat between a low-temperature fluid and a high-temperature fluid.

Background Art

Heat exchange systems for transferring heat between a low-temperature fluid and a high-temperature fluid are known. Such a heat exchange system is disclosed in Japanese Patent Laid-Open Publication No. JP 2010-101617, for example. The heat exchange system is particularly used in applications such as liquefaction or vaporization of flows of natural gas.

PRIOR ART

Patent Document

Patent Document 1: Japanese Patent Laid-Open Publication No. JP 2010-101617

SUMMARY OF THE INVENTION

Problems to be Solved by the Invention

However, in the heat exchange system, first and second passages are alternately stacked on each other. For this reason, for example, when a first fluid being lower temperature (low-temperature fluid) is a cryogenic liquefied gas, and a second fluid being higher temperature (high-temperature fluid) is water, antifreeze, or the like, the high-temperature fluid may freeze during the transferring heat.

In response to the above issue, one or more aspects of the present invention are directed to a heat exchange system capable of preventing, when transferring heat between a low-temperature fluid and a liquid high-temperature fluid, the high-temperature fluid from freezing.

Means for Solving the Problems

A heat exchange system according to a first aspect of the present invention includes a first heat exchanger for transferring heat between a low-temperature fluid and a high-temperature fluid whose temperature is higher than the low-temperature fluid; a second heat exchanger for transferring heat between flows of the low-temperature fluid; and a heater, the second heat exchanger including a first inlet configured for the low-temperature fluid to flow into, a first outlet which communicates with the first inlet, a second inlet configured for the low-temperature fluid to flow into, and a second outlet which communicates with the second inlet, wherein the second heat exchanger is configured to transfer heat between the low-temperature fluid flowing in from the first inlet and the low-temperature fluid flowing out from the first outlet and flowing in from the second inlet, the heater is provided between the first outlet and the second inlet and is configured to heat the low-temperature fluid flowing out from the first outlet, the low-temperature fluid flowing out from the second outlet can flow into the first exchanger.

Effect of the Invention

According to the present invention, it is possible to provide a heat exchange system capable of preventing a high-temperature fluid from freezing when transferring heat between a low-temperature fluid and the high-temperature fluid.

DESCRIPTION OF THE PREFERRED EMBODIMENTS

An embodiment according to the present invention will be described with reference to the drawings.

Configuration of Heat Exchange System

Figure 1:
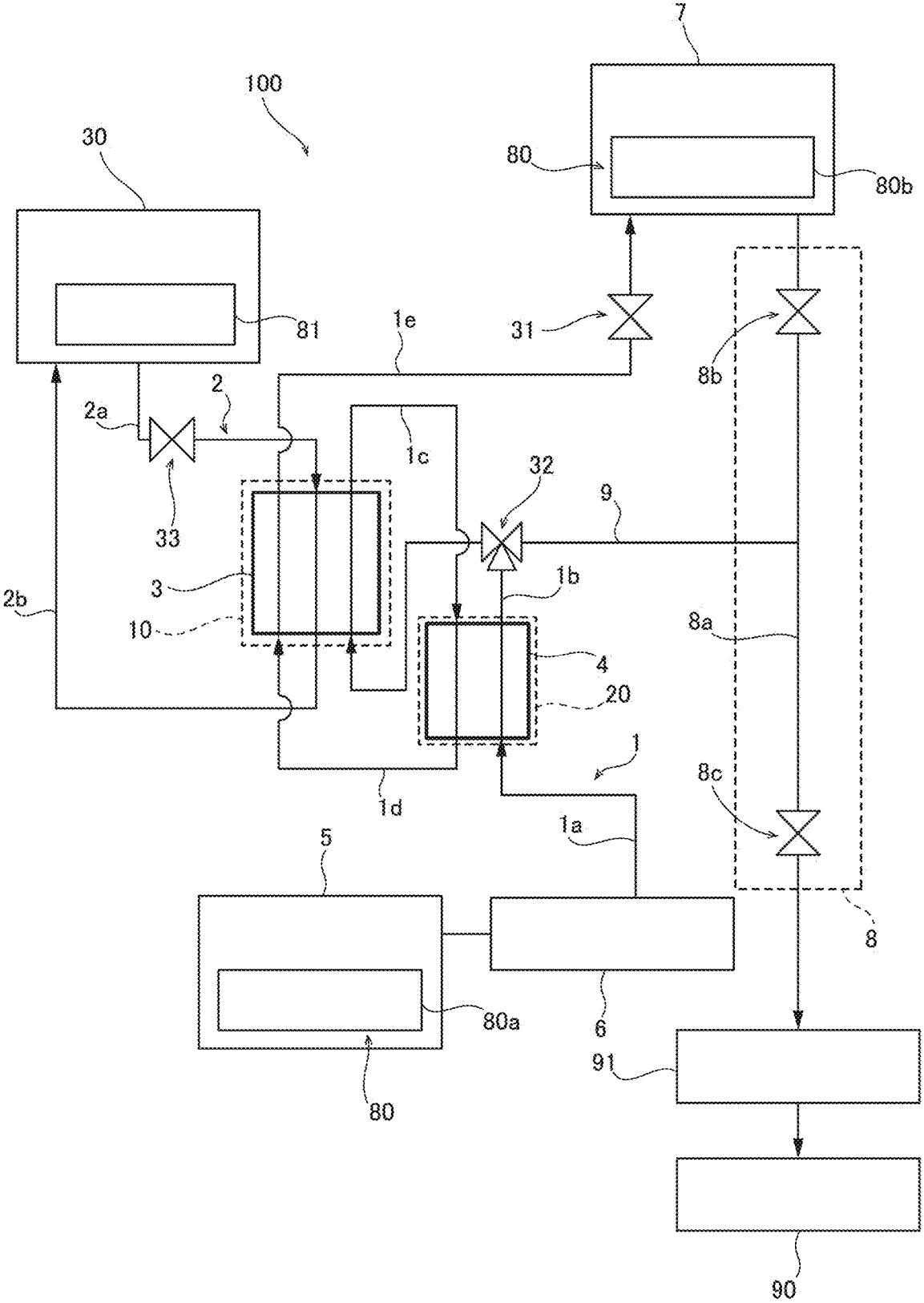
FIG. 1 is a diagram showing an entire configuration of a heat exchange system according to an embodiment.

As shown in FIG. 1, a heat exchange system 100 according to the embodiment of the present invention includes a low-temperature flow path 1, a high-temperature flow path 2, and a first heat exchanger 3, a second heat exchanger 4, a heater, a low-temperature fluid tank 5, a low-temperature fluid pump 6, a low-temperature fluid reservoir 7, a supplier 8, branch flow path 9 and a high-temperature fluid tank 30.

The low-temperature flow path 1 is a flow path through which a low-temperature fluid 80 being lower temperature. The low-temperature flow path 1 has one end connected to the low-temperature fluid pump 6, and another end connected to the low-temperature fluid reservoir 7. The low-temperature flow path 1 is, for example, one or more pipes.

Here, the low-temperature fluid 80 is, for example, liquid hydrogen, liquid helium, liquefied natural gas, or the like. In this embodiment, the low-temperature fluid 80 is liquid hydrogen.

In this embodiment, the low-temperature flow path 1 includes a first low-temperature flow path part 1*a*, a second low-temperature flow path part 1*b*, a third low-temperature flow path part 1*c*, a fourth low-temperature flow path part 1*d* and the fifth low-temperature flow path part 1*e*.

The first low-temperature flow path part 1*a* is configured to connect the low-temperature fluid pump 6 to the second heat exchanger 4. Also, the second low-temperature flow path part 1*b* is configured to connect the second heat exchanger 4 to the first heat exchanger 3. Also, the third low-temperature flow path part 1*c* is configured to connect the first heat exchanger 3 to the second heat exchanger 4.

Also, the fourth low-temperature flow path part 1*d* is configured to connect the second heat exchanger 4 to the first heat exchanger 3. Also, the fifth low-temperature flow path part 1*e* is configured to connect the first heat exchanger 3 to the low-temperature fluid reservoir 7.

Accordingly, the low-temperature fluid 80 stored in the low-temperature fluid tank 5 is flowed through first low-temperature flow path part 1*a*, the second heat exchanger 4, the second low-temperature flow path part 1*b*, the first heat exchanger 3, the third low-temperature flow path part 1*c*, the second heat exchanger 4, the fourth low-temperature flow path part 1*d*, the first heat exchanger 3 and the fifth low-temperature flow path part 1*e* in this order by the low-temperature fluid pump 6, and is stored in the low-temperature fluid reservoir 7. In this embodiment, the heat exchange system 100 is a system for storing the low-temperature fluid 80*b* (hydrogen gas) that is vaporized from the liquid low-temperature fluid 80*a* that is liquid hydrogen by transferring heat by using the first heat exchanger 3 and the second heat exchanger 4 into the low-temperature fluid reservoir 7.

The high-temperature flow path 2 is a flow path for flowing the high-temperature fluid 81, which is a liquid higher in temperature than the low-temperature fluid 80. The first heat exchanger 3 is arranged at a midpoint of the high-temperature flow path 2. The high-temperature flow path 2 is, for example, one or more pipes. Also, the high-temperature fluid 81 is, for example, warm water, ethylene glycol, or the like. In this embodiment, the high-temperature fluid 81 is warm water. It is preferable that the warm water is water heated to a temperature in a range from 40° C. to 70° C. It is more preferable that the warm water is water heated to a temperature in a range from 50° C. to 60° C.

In this embodiment, high-temperature flow path 2 includes the first high-temperature flow path part 2*a* and the second high-temperature flow path part 2*b*.

The first high-temperature flow path part 2*a* is configured to connect the high-temperature fluid tank 30 to the first heat exchanger 3. Also, the second high-temperature flow path part 2*b* is configured to connect the first heat exchanger 3 to the high-temperature fluid tank 30.

Accordingly, the high-temperature fluid 81 that flows out from the high-temperature fluid tank 30 flows through the first high-temperature flow path part 2*a*, the first heat exchanger 3 and the second high-temperature flow path part 2*b*, and flows back into the high-temperature fluid tank 30.

The first heat exchanger 3 also serves as the heater. The first heat exchanger 3 is configured to transfer heat between the low-temperature fluid 80 and the high-temperature fluid 81. The first heat exchanger 3 is provided in the first heat exchange unit 10. Configurations of the first heat exchanger 3 and the first heat exchange unit 10 are described in detail later.

The second heat exchanger 4 is configured to transfer heat between flows of the low-temperature fluid 80. In this embodiment, the second heat exchanger 4 is provided in the second heat exchange unit 20 connected to the first heat exchange unit 10. That is, the first heat exchanger 3 and the second heat exchanger 4 are provided in the first heat exchange unit 10 and the second heat exchange unit 20, which are different from each other, respectively. In other words, the first heat exchanger 3 and the second heat exchanger 4 are separately provided. Here, the second heat exchange unit 20 is connected to the first heat exchange unit 10 through the low-temperature flow path 1. Configurations of the second heat exchanger 4 and the second heat exchange unit 20 are described in detail later.

In this embodiment, the second flow-rate adjustment valve 32 is provided to the second low-temperature flow path part 1*b*, which connects the second heat exchanger 4 to the first heat exchanger 3, of the low-temperature flow path 1, as shown in FIG. 1. The second flow-rate adjustment valve 32 is arranged at a position separating the low-temperature flow path 1 from the branch flow path 9. The second flow-rate adjustment valve 32 is configured to be able to adjust a flow rate of the low-temperature fluid 80 that flows through the low-temperature flow path 1 and a flow rate of the low-temperature fluid 80 that flows through the branch flow path 9. Accordingly, the flow rate of the low-temperature fluid 80 that flows from the second heat exchanger 4 to the first heat exchanger 3 and the flow rate of the low-temperature fluid 80 that flows through the branch flow path 9 are adjusted by controlling the second flow-rate adjustment valve 32. Here, the second flow-rate adjustment valve 32 is configured to be able to adjust an amount of the low-temperature fluid 80 that flows through the low-temperature flow path 1 and an amount of the low-temperature fluid 80 that flows through the branch flow path 9. That is, the low-temperature fluid 80 can be flowed through both the low-temperature flow path 1 and the branch flow path 9 by adjusting the flow rates of the low-temperature fluid 80 by using the second flow-rate adjustment valve 32. Also, the second flow-rate adjustment valve 32 is configured to be able to flow the low-temperature fluid 80 only through the low-temperature flow path 1 and to be able to flow the low-temperature fluid 80 only through the branch flow path 9 by adjusting the flow rates of the low-temperature fluid 80. Also, the second flow-rate adjustment valve 32 may be electrically controlled (automatically controlled) by a control circuit (not shown), or mechanically controlled (manually controlled) by a human operator, or the like.

The low-temperature fluid tank 5 is configured to store the liquid low-temperature fluid 80.

The low-temperature fluid pump 6 is configured to flow the low-temperature fluid 80 stored in the low-temperature fluid tank 5 through the low-temperature flow path 1. The low-temperature fluid pump 6 is connected to the low-temperature fluid tank 5 and the low-temperature flow path 1, and is configured to flow the low-temperature fluid 80 stored in the low-temperature fluid tank 5 through the low-temperature flow path 1. In this embodiment, the low-temperature fluid pump 6 is configured to increase a pressure of the low-temperature fluid 80 to a predetermined pressure. The predetermined pressure is, for example, 80 MPa (megapascals). Here, any type of low-temperature fluid pump 6 can be used as long as it can flow the low-temperature fluid 80 through the low-temperature flow path 1 after increasing the pressure of the low-temperature fluid 80 to the predetermined pressure.

The low-temperature fluid reservoir 7 is configured to store the low-temperature fluid 80 that is heated and vaporized by the first heat exchanger 3. The low-temperature fluid reservoir 7 is connected to the low-temperature flow path 1 and the supply flow path 8*a*, which will be described later. The low-temperature fluid reservoir 7 stores the low-temperature fluid 80 that flows from the low-temperature flow path 1 at a predetermined temperature. In this embodiment, the low-temperature fluid reservoir 7 is configured to store the gaseous low-temperature fluid 80*b*. Also, the low-temperature fluid reservoir 7 is configured to flow the low-temperature fluid 80 (gaseous low-temperature fluid 80*b*) into the supply flow path 8*a*. The low-temperature fluid reservoir 7 is, for example, a pressure storage reservoir.

Here, a first flow-rate adjustment valve 31 is provided in the fifth low-temperature flow path part 1*e* between the first heat exchanger 3 and the low-temperature fluid reservoir 7. The first flow-rate adjustment valve 31 is configured to be able to adjust a flow rate of the low-temperature fluid 80 that flows through the low-temperature flow path 1. Accordingly, the flow rate of the low-temperature fluid 80 that flows into the low-temperature fluid reservoir 7 is adjusted by controlling the first flow-rate adjustment valve 31 and the second flow-rate adjustment valve 32. Here, the first flow-rate adjustment valve 31 may be electrically controlled (automatically controlled) by the control circuit (not shown), or mechanically controlled (manually controlled) by the human operator, or the like.

The supplier 8 is connected to the low-temperature fluid reservoir 7, and is configured to supply the vaporized low-temperature fluid 80 to a to-be-supplied subject 90. The supplier 8 includes a supply flow path 8*a*, a first supply valve 8*b* and a second supply valve 8*c*. Also, the supplier 8 is connected to a dispenser 91 for supplying the low-temperature fluid 80 to the to-be-supplied subject 90. The dispenser 91 is, for example, a dispenser that supplies the vaporized low-temperature fluid 80. The to-be-supplied subject 90 is, for example, an automobile.

The first supply valve 8*b* is configured to be able to adjust a flow rate of the low-temperature fluid 80 that flows from the low-temperature fluid reservoir 7 to the supply flow path 8*a*. The first supply valve 8*b* is, for example, a flow-rate adjustment valve.

The second supply valve 8*c* is configured to be able to adjust a flow rate of the low-temperature fluid 80 that is supplied to the to-be-supplied subject 90. The second supply valve 8*c* is, for example, a flow-rate adjustment valve.

The branch flow path 9 is configured to branch from low-temperature flow path 1 (second low-temperature flow path part 1*b*) and to be connected to the supplier 8 to flow the low-temperature fluid 80 through the branch flow path. The branch flow path 9 has one end connected to the low-temperature flow path 1 (second low-temperature flow path part 1*b*) through the second flow-rate adjustment valve 32, and another end connected to the supply flow path 8*a*. The branch flow path 9 is a flow path for flowing the low-temperature fluid 80 that flows through the low-temperature flow path 1 into the supply flow path 8*a*. The branch flow path 9 is, for example, one or more pipes.

The high-temperature fluid tank 30 is configured to store the high-temperature fluid 81. Also, the high-temperature fluid tank 30 is connected to the first heat exchanger 3 through the high-temperature flow path 2. Also, a third flow-rate adjustment valve 33 is provided in the high-temperature flow path 2 between the high-temperature fluid tank 30 and the first heat exchanger 3.

The third flow-rate adjustment valve 33 is configured to be able to adjust a flow rate of the high-temperature fluid 81 that flows from the high-temperature fluid tank 30 to the first heat exchanger 3. Also, the third flow-rate adjustment valve 33 is adjusted to flow the high-temperature fluid 81 into the high-temperature flow path 2 during the heat exchange system 100 is in operation. Specifically, the third flow-rate adjustment valve 33 is configured to continue flowing the high-temperature fluid 81 during the heat exchange system 100 is in operation. Here, the third flow-rate adjustment valve 33 may be electrically controlled (automatically controlled) by the control circuit (not shown), or mechanically controlled (manually controlled) by the human operator, or the like.

As shown in FIG. 1, the low-temperature fluid 80 (liquid low-temperature fluid 80*a*) stored in the low-temperature fluid tank 5 flows into the second heat exchanger 4 and the first heat exchanger 3 through the low-temperature flow path 1. Subsequently, the low-temperature fluid 80 is vaporized by transferring heat in the second heat exchanger 4 and the first heat exchanger 3, and is then stored as the gaseous low-temperature fluid 80*b* in the low-temperature fluid reservoir 7. In addition, the vaporized low-temperature fluid 80 (low-temperature fluid 80*b* of gas) stored in the low-temperature fluid reservoir 7 is supplied to the to-be-supplied subject 90 by dispenser 91 through the supplier 8.

Also, the high-temperature fluid 81 stored in the high-temperature fluid tank 30 flows into the first heat exchanger 3 through the high-temperature flow path 2. The high-temperature fluid 81 after transferring heat in the first heat exchanger 3 is heated by the heater (not shown), and flows into the high-temperature fluid tank 30. Here, the high-temperature fluid 81 transferring heat may be discharged to a fluid discharger (not shown).

First Heat Exchange Unit

Figure 2:
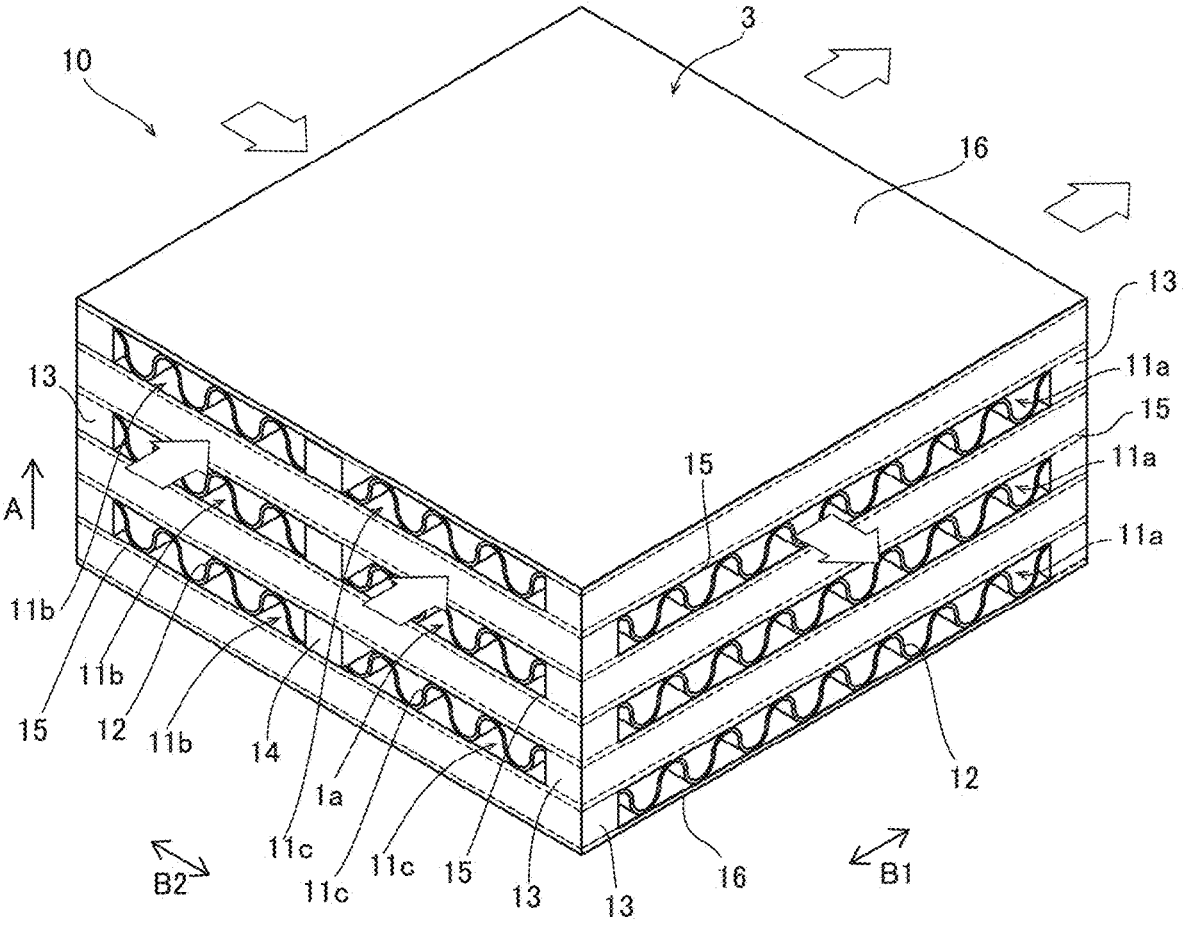
FIG. 2 is a perspective view showing a configuration of a first heat exchange unit including a first heat exchanger according to the embodiment.

The following description describes the first heat exchange unit 10 with reference to FIG. 2. As shown in FIG. 2, the first heat exchange unit 10 according to this embodiment includes a plate-fin type first heat exchanger 3. The plate-fin type first heat exchanger 3 is a heat exchanger having a multilayer structure including a plurality of layers of planar (layered) first flow path parts 11*a*, and a plurality of layer sets of second flow path parts 11*b* and third flow path parts 11*c*, which are stacked on each other.

The first heat exchanger 3 has a planar (flat pale) structure that includes fins 12, which form individual flow paths (channels), and sidebars 13 that form outer walls of the fins 12. Also, intermediate bars 14 are arranged at midpoint positions between the sidebars 13 of each layer in which the second flow path parts 11*b* and the third flow path parts 11*c* are arranged. Although the fins 12 can have various types of shapes, the fins 12 are illustratively shown as wave-shaped corrugated fins in FIG. 2.

No intermediate bar 14 is arranged in the layers in which the first flow path parts 11*a* are arranged. In other words, the sidebars 13 in the layers in which the first flow path parts 11*a* are arranged are arranged to close outer peripheries of the first flow path parts 11*a* except for inlets and outlets of the first flow path parts 11*a*. Also, the first flow path parts 11*a* are partitioned by plates 15, which are partition walls on both sides in a direction A. That is, the first flow path parts 11*a* are space parts defined by the fins 12, the sidebars 13, and the plates 15. Also, headers or the like (not shown) are attached to the inlets and outlets of the first flow path parts 11*a* so that the fluid flows into/out of the first flow path parts 11*a* through the headers. Here, the header attached to one side of the first flow path parts 11*a* is connected to a high-temperature side inlet 3*a* (see FIG. 4), which will be described later. Also, the header attached to another side of the first flow path parts 11*a* is connected to a high-temperature side outlet 3*b* (see FIG. 4), which will be described later. The plates 15 and the fins 12 serve as heat transfer surfaces to transfer heat in the first heat exchanger 3. Here, the direction A is a direction in which the first flow path parts 11*a*, sets of the second flow path parts 11*b* and the third flow path parts 11*c* are stacked on each other. Directions perpendicular to the direction A refer to directions B, and two directions perpendicular to each other in the directions B refer to a direction B1 and a direction B2.

The sidebars 13 and the intermediate bars 14 are arranged to close outer peripheries of the second flow path parts 11*b* except for inlets and outlets of the second flow path parts 11*b*. Also, the second flow path parts 11*b* are partitioned by the plates 15, which are partition walls on both sides in the direction A. That is, the second flow path parts 11*b* are defined by the fins 12, the sidebars 13, the intermediate bars 14, and the plates 15. Also, headers or the like (not shown) are attached to the inlets and outlets of the second flow path parts 11*b* so that the fluid flows into/out of the second flow path parts 11*b* through the headers. Here, the header attached to one side of the second flow path parts 11*b* is connected to a first low-temperature side inlet 3*c* (see FIG. 4), which will be described later. Also, the header attached to another side of the second flow path parts 11*b* is connected to a first low-temperature side outlet 3*d* (see FIG. 4), which will be described later.

The third flow path parts 11*c* have a configuration similar to the second flow path parts 11*b*. That is, the third flow path parts 11*c* are defined by the fins 12, the sidebars 13, the intermediate bars 14, and the plates 15. Also, headers or the like (not shown) are attached to the inlets and outlets of the third flow path parts 11*c* so that the fluid flows into/out of the third flow path parts 11*c* through the headers. Here, the header attached to one side of the third flow path parts 11*c* is connected to a second low-temperature side inlet 3*e* (see FIG. 4), which will be described later. Also, the header attached to another side of the third flow path parts 11*c* is connected to a second low-temperature side outlet 3*f* (see FIG. 4), which will be described later.

Also, a pair of end plates 16 are arranged on outermost parts (upper and lower surfaces) of the flow paths in the direction A. Each first flow path part 11*a* is formed in a rectangular shape as viewed in a plan view. Also, each second flow path part 11*b* is formed in a rectangular shape as viewed in the plan view. Also, each third flow path part 11*c* is formed in a rectangular shape as viewed in the plan view. A sum of lengths of the second flow path parts 11*b* and lengths of the third flow path parts 11*c* in the direction B2 is equal to the length of each first flow path part 11*a* in the direction B1. Accordingly, the first heat exchanger 3 is formed in a rectangular box shape (rectangular parallelepiped shape) as a whole.

The plurality of first flow path parts 11*a* are connected to the high-temperature flow paths 2 (see FIG. 1) to flow the high-temperature fluid 81 (see FIG. 1) through the first flow path parts. Also, the plurality of second flow path parts 11*b* are connected to the second low-temperature flow path part 1*b* (see FIG. 1) and the third low-temperature flow path part 1*c* to flow the low-temperature fluid 80 (see FIG. 1) through the second flow path parts. Also, the plurality of third flow path parts 11*c* are connected to the fourth low-temperature flow path part 1*d* (see FIG. 1) and the fifth low-temperature flow path part 1*e* to flow the low-temperature fluid 80 whose temperature is different from the low-temperature fluid 80 that flows through the second flow path parts 11*b*. The first heat exchanger 3 transfers heat between the high-temperature fluid 81 that flows through the first flow path parts 11*a*, the low-temperature fluid 80 that flows through the second flow path parts 11*b*, and the low-temperature fluid 80 that flows through the third flow path parts 11*c*. Here, in this embodiment, heat is transferred between the high-temperature fluid 81 that flows through the first flow path parts 11*a*, a set of the low-temperature fluid 80 that flows through the second flow path parts 11*b* and the low-temperature fluid 80 that flows through the third flow path parts 11*c* by the first heat exchanger 3 in a one-to-two relation. FIG. 2 is a view showing an exemplary perpendicular-flow type heat exchange unit in which a flow direction of the low-temperature fluid 80 (see FIG. 1) and a flow direction of high-temperature fluid 81 (see FIG. 1) are perpendicular to each other in the direction B. The first heat exchange unit 10 may be a parallel-flow type heat exchange unit in which the flow direction of low-temperature fluid 80 and the flow direction of high-temperature fluid 81 are the same direction, or a counter-flow type heat exchange unit in which the flow direction of low-temperature fluid 80 and the flow direction of high-temperature fluid 81 are directions opposite to each other.

Second Heat Exchange Unit

Figure 3:
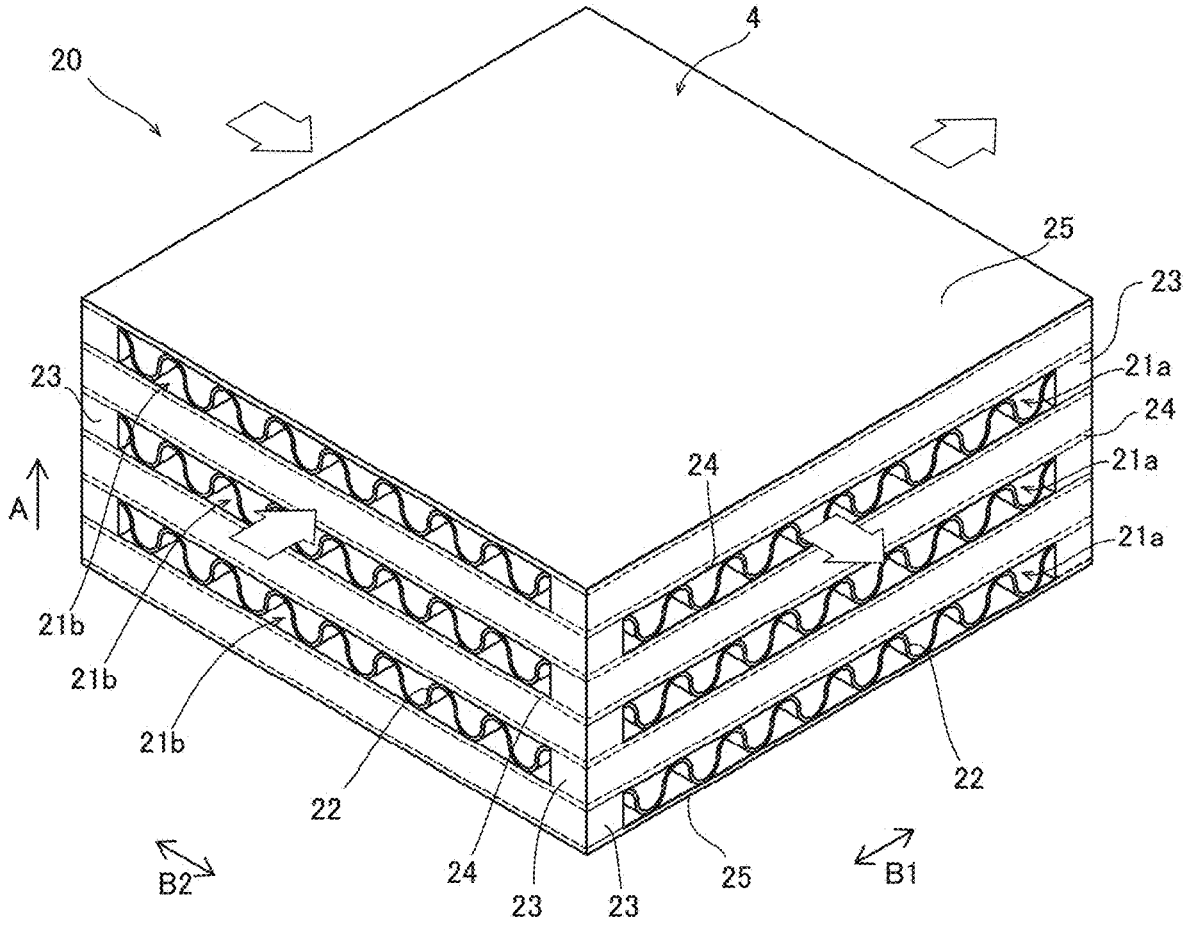
FIG. 3 is a perspective view showing a configuration of a second heat exchange unit including a second heat exchanger according to the embodiment.

The following description describes the second heat exchange unit 20 with reference to FIG. 3. As shown in FIG. 3, the second heat exchange unit 20 according to this embodiment includes a plate-fin type second heat exchanger 4. The plate-fin type second heat exchanger 4 is a heat exchanger having a multilayer structure including a plurality of layers of planar (layered) first flow path parts 21*a*, and a plurality of layers of second flow path parts 21*b*, which are stacked on each other.

The second heat exchanger 4 has a planar (flat pale) structure that includes fins 22, which form individual flow paths (channels), and sidebars 23 that form outer walls of the fins 22. Although the fins 22 can have various types of shapes, the fins 22 are illustratively shown as wave-shaped corrugated fins in FIG. 3.

The sidebars 23 are arranged to close outer peripheries of the first flow path parts 21*a* except for inlets or outlets of the first flow path parts 21*a*. Also, the first flow path parts 21*a* are partitioned by plates 24, which are partition walls on both sides in a direction A. That is, the first flow path parts 21*a* are space parts defined by the fins 22, the sidebars 23, and the plates 24. Also, headers or the like (not shown) are attached to the inlets and outlets of the first flow path parts 21*a* so that the fluid flows into/out of the first flow path parts 21*a* through the headers.

Also, the sidebars 23 are arranged to close outer peripheries of the second flow path parts 21*b* except for inlets or outlets of the second flow path parts 21*b*. Also, the second flow path parts 21*b* are partitioned by the plates 24, which are partition walls on both sides in the direction A. That is, the second flow path parts 21*b* are space parts defined by the fins 22, the sidebars 23, and the plates 24. Also, headers or the like (not shown) are attached to the inlets and outlets of the second flow path parts 21*b* so that the fluid flows into/out of the second flow path parts 21*b* through the headers. The plates 24 and the fins 22 serve as heat transfer surfaces to transfer heat in the second heat exchanger 4.

Also, a pair of end plates 25 are arranged on outermost parts (upper and lower surfaces) of the flow paths in the direction A. Each first flow path part 21*a* is formed in a rectangular shape as viewed in a plan view. Also, each second flow path part 21*b* is formed in a rectangular shape as viewed in the plan view. Accordingly, the second heat exchanger 4 is formed in a rectangular box shape (rectangular parallelepiped shape) as a whole.

The plurality of first flow path parts 21*a* are connected to the first low-temperature flow path part 1*a* (see FIG. 1) and the second low-temperature flow path part 1*b* to flow the low-temperature fluid 80 (see FIG. 1) through the first flow path parts. Also, the plurality of second flow path parts 21*b* are connected to the third low-temperature flow path part 1*c* (see FIG. 1) and the fourth low-temperature flow path part 1*d* to flow the low-temperature fluid 80 whose temperature is different from the low-temperature fluid that flows through the first flow path parts 21*a*. The second heat exchanger 4 transfers heat between the low-temperature fluid 80 that flows through the first flow path parts 21*a*, and the low-temperature fluid 80 that flows through the second flow path parts 21*b*. FIG. 3 is a view showing an exemplary perpendicular-flow type heat exchange unit in which an extension direction of the first flow path parts 21*a* and an extension direction of the second flow path parts 21*b* are perpendicular to each other as the directions B. The second heat exchange unit 20 may be a parallel-flow type heat exchange unit in which the extension direction of the first flow path parts 21*a* and the extension direction of the second flow path parts 21*b* are the same direction, or a counter-flow type heat exchange unit in which the extension direction of the first flow path parts 21*a* and the extension direction of the second flow path parts 21*b* are directions opposite to each other.

Here, the low-temperature fluid tank 5 (see FIG. 1) stores the low-temperature fluid 80 (see FIG. 1), which is liquid hydrogen. Temperature of the liquid hydrogen is substantially −250° C. Contrary to this, the temperature of the high-temperature fluid 81 (see FIG. 1) stored in the high-temperature fluid tank 30 (see FIG. 1) is, for example, a temperature in a range from 50° C. to 60° C. Accordingly, if the heat exchange system 100 does not have the heater (first heat exchanger 3), when heat is transferred between the low-temperature fluid 80 that flows from the low-temperature fluid tank 5 and the high-temperature fluid 81 that flows from the high-temperature fluid tank 30, the high-temperature fluid 81 may freeze. If the liquid high-temperature fluid 81 freezes, a flow rate of the high-temperature fluid 81 that flows through the high-temperature flow path 2 (see FIG. 1) decreases, and as a result efficiency of heat transferring between the low-temperature fluid 80 and the high-temperature fluid 81 decreases.

Heat Transferring in First and Second Heat Exchangers

To address this, in this embodiment, the heat exchange system is configured to transfer heat between flows of the low-temperature fluid 80 in the second heat exchanger 4 prior to transferring heat between the low-temperature fluid 80 (see FIG. 1) and the high-temperature fluid 81 (see FIG. 1) in the first heat exchanger 3 (see FIG. 1).

Figure 4:
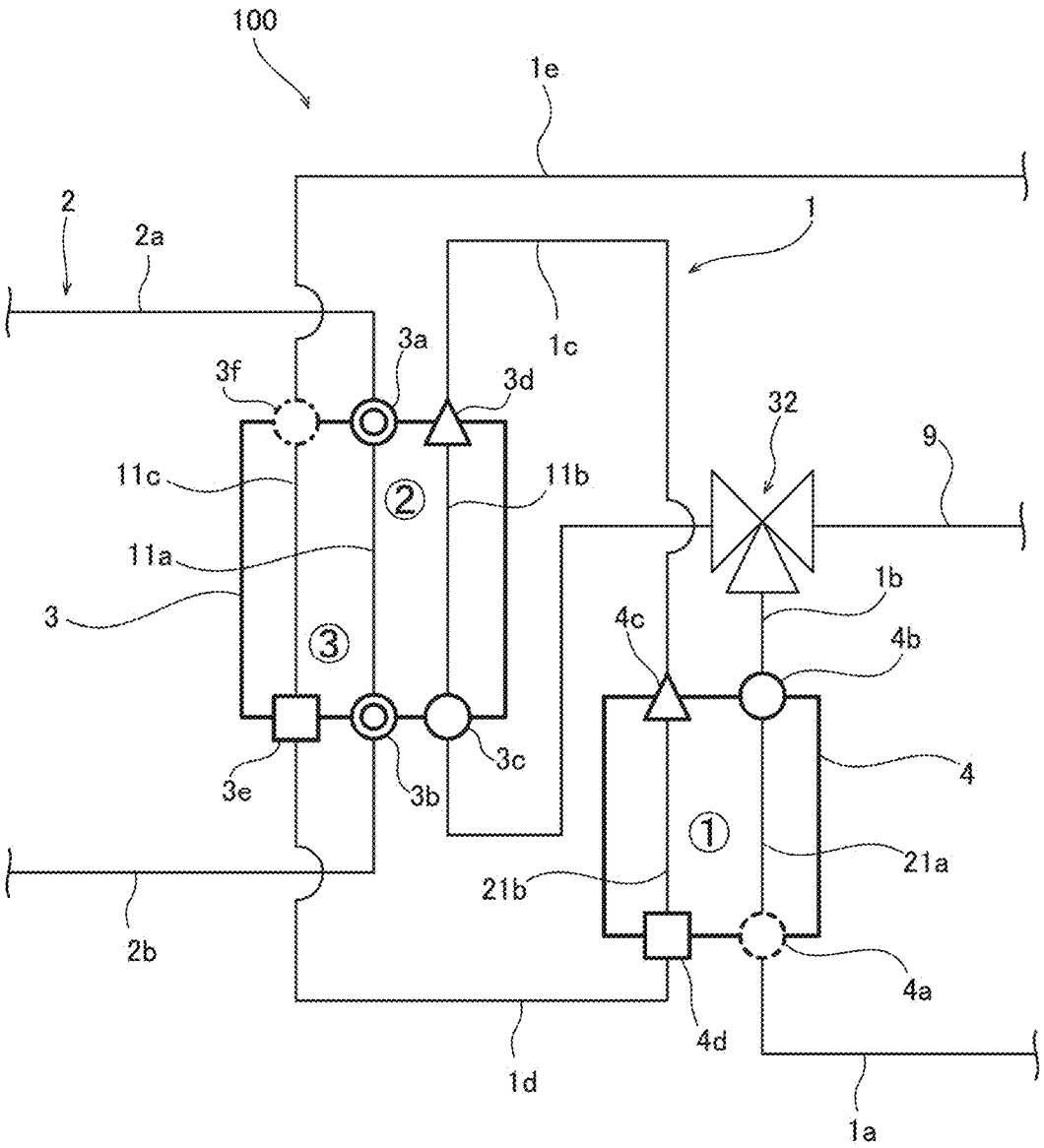
FIG. 4 is a diagram showing a configuration of connection between the first heat exchanger and the second heat exchanger, and flow paths of a low-temperature fluid and a high-temperature fluid according to the embodiment.
Figure 5:
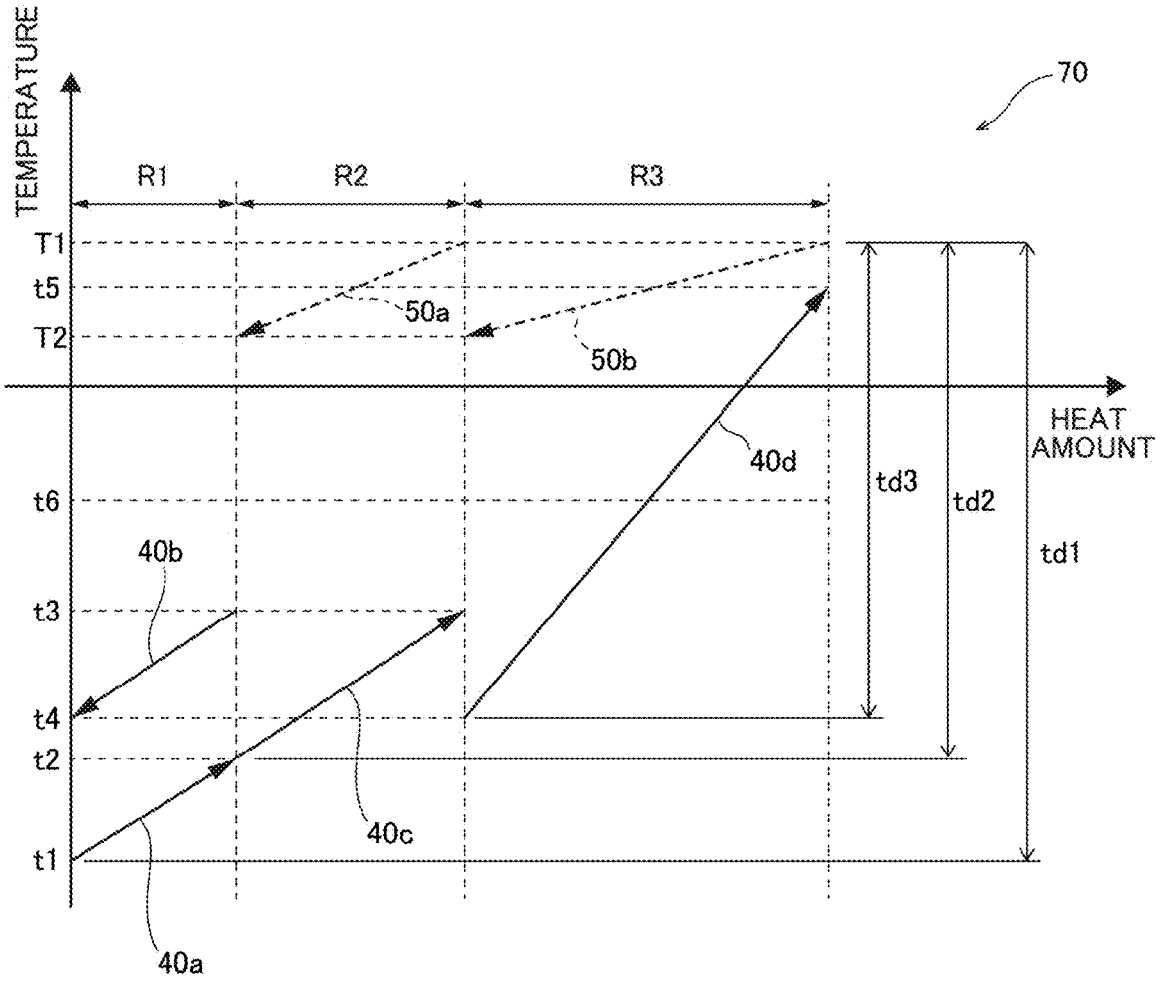
FIG. 5 is a diagram showing heat exchange between flows of a first fluid, and exchange between flows of the first fluid and a second fluid in the heat exchange system according to the embodiment.

The following description describes heat transferring between fluids in the first heat exchanger 3 and the second heat exchanger 4 with reference to FIGS. 4 and 5. Here, in an exemplary connection configuration shown in FIG. 4, to easily grasp the connections between the inlets and the outlets of the first heat exchanger 3 and the second heat exchanger 4, the same symbols are attached to the inlet and the outlet of the first heat exchanger 3 and the second heat exchanger 4 that communicate with each other in each connection for illustration.

Connections Between First and Second Heat Exchangers

The connections between the first heat exchanger 3 and the second heat exchanger 4 are first described with reference to FIG. 4. As shown in FIG. 4, the second heat exchanger 4 includes a first inlet 4*a* configured for the low-temperature fluid 80 (see FIG. 1) to flow into, a first outlet 4*b* which communicates with the first inlet 4*a* and is configured for the low-temperature fluid 80 that flows into through the first inlet 4*a* to flow out after heat transferring, a second inlet 4*c* configured for the low-temperature fluid 80 that flows out through the first outlet 4*b* and then flows through the first heat exchange unit 10 (second flow path parts 11*b*) to flow into, and a second outlet 4*d* which communicates with the second inlet 4*c* and is configured for the low-temperature fluid 80 that flows through the second inlet 4*c* into to flow out after heat transferring. That is, the second heat exchanger 4 is configured to transfer heat between the low-temperature fluid 80 that flows into the second heat exchanger through the first inlet 4*a* and the low-temperature fluid 80 that flows into the second heat exchanger through the second inlet 4*c*. The first inlet 4*a* and the first outlet 4*b* are connected to each other by the first flow path parts 21*a*. The second inlet 4*c* and the second outlet 4*d* are connected by the second flow path parts 21*b*.

Here, in the exemplary connection configuration shown in FIG. 4, different symbols are attached to the first inlet 4*a*, the first outlet 4*b*, the second inlet 4*c* and the second outlet 4*d* for convenience. Specifically, a dashed-line circle is attached to the first inlet 4*a*. Also, a solid-line circle is attached to the first outlet 4*b*. Also, a solid-line triangle is attached to the second inlet 4*c*. Also, a solid-line square is attached to the second outlet 4*d*.

Also, as shown in FIG. 4, the first heat exchanger 3 includes a high-temperature side inlet 3*a* through which the high-temperature fluid 81 (see FIG. 1) flows into the first heat exchanger, and a high-temperature side outlet 3*b* which communicates with the high-temperature side inlet 3*a*. The high-temperature side inlet 3*a* and the high-temperature side outlet 3*b* are connected by the first flow path parts 11*a*. The high-temperature fluid 81 that flows from the high-temperature fluid tank 30 (see FIG. 1) into the first heat exchanger 3 flows into the first heat exchanger 3 through the high-temperature side inlet 3*a*. Also, the high-temperature fluid 81 that flows into the first heat exchanger 3 flows out of the first heat exchanger 3 through the high-temperature side outlet 3*b*. Here, in the exemplary connection configuration shown in FIG. 4, double solid-line circles are attached to the high-temperature side inlet 3*a* and the high-temperature side outlet 3*b* for convenience.

Also, the first heat exchanger 3 includes the first low-temperature side inlet 3*c* which communicates with the first outlet 4*b* of the second heat exchanger 4 and is configured for the low-temperature fluid 80 to flow into, and the first low-temperature side outlet 3*d* which communicates with the first low-temperature side inlet 3*c*. The first low-temperature side inlet 3*c* and the first low-temperature side outlet 3*d* are connected to each other by the second flow path parts 11*b*.

Also, in this embodiment, the first heat exchanger 3 includes the second low-temperature side inlet 3*e*, which communicates with the second outlet 4*d* of the second heat exchanger 4, and the second low-temperature side outlet 3*f*, which communicates with the second low-temperature side inlet 3*e*. That is, the first heat exchanger 3 (heater) is provided between the first outlet 4*b* and the second inlet 4*c*. The second low-temperature side inlet 3*e* and the second low-temperature side outlet 3*f* are connected to each other by the third flow path parts 11*c*. The first low-temperature side inlet 3*c*, the first low-temperature side outlet 3*d*, the second low-temperature side inlet 3*e*, and the second low-temperature side outlet 3*f*, which are included in the first heat exchanger 3, are attached with the symbols corresponding to the inlets and the outlets to which they are connected in the inlets and the outlets of the second heat exchanger 4.

The first inlet 4*a* of the second heat exchanger 4, which is indicated by the dashed-line circle, is connected to the low-temperature fluid tank 5 (see FIG. 1) by the low-temperature flow path 1. Specifically, the first inlet 4*a* is connected to the low-temperature fluid tank 5 by the first low-temperature flow path part 1*a*.

Also, the first outlet 4*b* of the second heat exchanger 4 communicates with the first low-temperature side inlet 3*c* of the first heat exchanger 3. Specifically, the first outlet 4*b* communicates with the first low-temperature side inlet 3*c* through the second low-temperature flow path part 1*b*. Accordingly, the low-temperature fluid 80 that flows out through the first outlet 4*b* flows through the first low-temperature side inlet 3*c* into the first heat exchanger 3. Here, in the exemplary connection configuration shown in FIG. 4, the solid-line circles are attached to the first outlet 4*b* and the first low-temperature side inlet 3*c*.

Also, the first low-temperature side outlet 3*d* of the first heat exchanger 3 communicates with the second inlet 4*c* of the second heat exchanger 4. Specifically, the first low-temperature side outlet 3*d* communicates with the second inlet 4*c* through the third low-temperature flow path part 1*c*. Accordingly, the low-temperature fluid 80 that flows out through the first low-temperature side outlet 3*d* flows through the third low-temperature flow path part 1*c*, and flows back into the second heat exchanger 4 through the second inlet 4*c*. Here, in the exemplary connection configuration shown in FIG. 4, the solid-line triangles are attached to the first low-temperature side outlet 3*d* and the second inlet 4*c*.

The second outlet 4*d* of the second heat exchanger 4 communicates with the second low-temperature side inlet 3*e* of the first heat exchanger 3. Specifically, the second outlet 4*d* communicates with the second low-temperature side inlet 3*e* through the fourth low-temperature flow path part 1*d*. Accordingly, the low-temperature fluid 80 that flows out through the second outlet 4*d* of the second heat exchanger 4 flows through the second low-temperature side inlet 3*e* of the first heat exchanger 3 into the first heat exchanger 3. Here, in the exemplary connection configuration shown in FIG. 4, solid-line squares are attached to the second outlet 4*d* and the second low-temperature side inlet 3*e*.

The second low-temperature side outlet 3*f*, which is indicated by a single-pointed line circle, is connected to the low-temperature fluid reservoir 7 (see FIG. 1) by the low-temperature flow path 1. Specifically, the second low-temperature side outlet 3*f* is connected to the low-temperature fluid reservoir 7 by the fifth low-temperature flow path part 1*e*.

Accordingly, the low-temperature fluid 80 (see FIG. 1) stored in low-temperature fluid tank 5 (see FIG. 1) flows through the first low-temperature flow path part 1*a*, the first flow path parts 21*a*, the second low-temperature flow path part 1*b*, the second flow path parts 11*b*, the third low-temperature flow path part 1*c*, the second flow path parts 21*b*, the fourth low-temperature flow path part 1*d*, the third flow path parts 11*c* and the fifth low-temperature flow path part 1*e* in this order into the low-temperature fluid reservoir 7.

Also, the high-temperature fluid tank 30 (see FIG. 1) is connected to the first heat exchanger 3 by the high-temperature flow path 2. Specifically, the high-temperature fluid tank 30 is connected to the first heat exchanger 3 by the first high-temperature flow path part 2*a*.

Also, the high-temperature side outlet 3*b* of the first heat exchanger 3 is connected to the second high-temperature flow path part 2*b*. Accordingly, the high-temperature fluid 81 (see FIG. 1) that flows from the high-temperature fluid tank 30 through the first high-temperature flow path part 2*a* flows through the high-temperature side inlet 3*a* into the first flow path parts 11*a*, and flows out through the high-temperature side outlet 3*b*, and flows through the second high-temperature flow path part 2*b*.

Transfer of Heat of Low-Temperature Fluid

The following description describes configurations of transferring heat of the low-temperature fluid 80 (see FIG. 1) in the heat exchangers with reference to FIG. 4 again.

The low-temperature fluid 80 (see FIG. 1) that flows into the low-temperature flow path 1 from the low-temperature fluid tank 5 (FIG. 1) transfers heat in an order of circled numbers 1 to 3 indicated in FIG. 4.

The first (circled number 1) heat transferring is executed in the second heat exchanger 4. The low-temperature fluid 80 that flows from the low-temperature fluid tank 5 (FIG. 1) into the second heat exchanger 4 (see FIG. 1) transfers heat from the low-temperature fluid 80 that flows out of the first heat exchanger 3. That is, the first heat transferring is executed between the low-temperature fluid 80 that flows into the first flow path parts 21*a* and the low-temperature fluid 80 that flows into the second flow path parts 21*b*. In other words, the first heat transferring is executed between the low-temperature fluid 80 that flows from the low-temperature fluid tank 5 and the low-temperature fluid 80 that flows out of the second heat exchanger 4 and is circulated by itself to flow into the second heat exchanger 4 again. The low-temperature fluid 80 that flows out of the first heat exchanger 3 transfers heat from the high-temperature fluid 81 (see FIG. 1) in the first heat exchanger 3. Accordingly, the low-temperature fluid 80 that flows out through the first outlet 4*b* is higher in temperature than the low-temperature fluid 80 that flows in through the first inlet 4*a*.

Here, when the heat exchange system 100 is activated, no low-temperature fluid 80 that flows through the second inlet 4*c* into the second heat exchanger 4 exists. In other words, the low-temperature fluid 80 that is heated by the first heat exchanger 3 to transfer heat to the low-temperature fluid 80 that is liquid hydrogen of substantially −250° C. does not flow into the second heat exchanger 4 in the activation. Accordingly, heat transferring between the low-temperature fluid 80 as the first heat transferring is not executed in the activation of the heat exchange system 100. Here, when the heat exchange system 100 is activated, the second heat exchanger 4 is at an ordinary temperature. Accordingly, a heat capacity of the second heat exchanger 4 heats the low-temperature fluid 80 that flows into the first flow path parts 21*a* in the activation of the heat exchange system 100. In this activation, since temperature difference between the second heat exchanger 4 and the low-temperature fluid 80 is large, a flow rate of the low-temperature fluid 80 that flows into the second heat exchanger 4 is reduced to reduce a thermal stress that occurs in the second heat exchanger 4. That is, the heat exchange system 100 is driven in a preparation mode of flowing a small amount of low-temperature fluid 80 so as to heat the low-temperature fluid 80 by using the heat capacity of the second heat exchanger 4 in the activation of the heat exchange system 100.

Subsequently, the low-temperature fluid 80 transfers heat as the second (circled 2) heat transferring. The second heat exchange is executed in the first heat exchanger 3. Specifically, the second heat transferring is executed between the high-temperature fluid 81 (see FIG. 1) that flows into the first flow path parts 11*a* and the low-temperature fluid 80 that flows into the second flow path parts 11*b*. In other words, the low-temperature fluid 80 whose heat is transferred by the second heat exchanger 4 and which flows out through the first outlet 4*b* flows into the first heat exchanger 3 and transfers heat from the high-temperature fluid 81. In other words, the first heat exchanger 3 (heater) is configured to heat the low-temperature fluid 80 that has flowed out through the first outlet 4*b* before flowing in through the second inlet 4*c*.

Here, the low-temperature fluid 80 that has transferred heat as the second transferring flows out through the first low-temperature side outlet 3*d*, flows through the third low-temperature flow path part 1*c*, and flows back into the second heat exchanger 4 through the second inlet 4*c*. In other words, the low-temperature fluid 80 that flows out through the first outlet 4*b* flows back into the second heat exchanger 4 through the second inlet 4*c* after transferring heat from the high-temperature fluid 81. Subsequently, the low-temperature fluid 80 that flows back to the second heat exchanger 4 through the second inlet 4*c* as a high-temperature side fluid transfers heat to the low-temperature fluid 80 that flows in the first flow path parts 21*a* in the first heat transferring. In this embodiment, the low-temperature fluid 80 that flows out through the second outlet 4*d* is higher in temperature than the low-temperature fluid 80 that flows out through the first outlet 4*b*. Here, in a case in which heat is transferred between the low-temperature fluid 80 that flows through the second outlet 4*d* and the low-temperature fluid 80 that flows through the first inlet 4*a*, it is conceived that temperatures of flows of the low-temperature fluid 80 after heat transferring becomes temperatures near an intermediate temperature between both the flows of the low-temperature fluid. Also, the low-temperature fluid 80 that flows out through the second outlet 4*d* may become at a temperature lower than the low-temperature fluid 80 that flows out through the first outlet 4*b*.

Subsequently, the low-temperature fluid 80 (see FIG. 1) transfers heat as the third (circled 3) heat transferring. The third heat transferring is executed in the first heat exchanger 3. Specifically, the third heat transferring is executed between the high-temperature fluid 81 (see FIG. 1) that flows into the first flow path parts 11*a* and the low-temperature fluid 80 that flows into the third flow path parts 11*c*. In other words, the low-temperature fluid 80 whose heat is transferred by the second heat exchanger 4 and which flows out through the second outlet 4*d* flows into the first heat exchanger 3 and transfers heat from the high-temperature fluid 81.

In this embodiment, the second heat transferring and the third heat transferring are executed in the first heat exchanger 3. In other words, the first heat exchanger 3 is configured to transfer heat between the high-temperature fluid 81 in the high-temperature flow path 2 and the low-temperature fluid 80 that flows in through the first low-temperature side inlet 3*c* of the first heat exchanger 3, and between the high-temperature fluid 81 in the high-temperature flow path 2 and the low-temperature fluid 80 that flows in through the second low-temperature side inlet 3*e* of the first heat exchanger 3. In other words, the first heat exchanger 3 is configured to transfer heat between three flows of fluids, which are a flow of the high-temperature fluid 81 that flows into the first flow path parts 11*a*, a flow of the low-temperature fluid 80 that flows into the second flow path parts 11*b*, and a flow of the low-temperature fluid 80 that flows into the third flow path parts 11*c*.

Subsequently, the low-temperature fluid 80 that has transferred heat as the third transferring flows out through the second low-temperature side outlet 3*f*, flows through the fifth low-temperature flow path part 1*e*, and is stored in the low-temperature fluid reservoir 7.

The following description describes transfer of heat between the low-temperature fluid 80 (see FIG. 1) and the high-temperature fluid 81 (see FIG. 1) in the heat exchangers in detail with reference to FIG. 5.

In a graph 70 shown in FIG. 5, its horizontal axis indicates a heat amount, and its vertical axis indicates temperature. The solid arrows 40*a* to 40*d* in the graph 70 show changes of temperature and the heat amount of the low-temperature fluid 80 (see FIG. 1). Specifically, the arrow 40*a* shows a change of temperature and the heat amount of the low-temperature fluid 80 that flows in through the first inlet 4*a* (see FIG. 4) and flows out through the first outlet 4*b* (see FIG. 4). Also, the arrow 40*b* shows a change of temperature and the heat amount of the low-temperature fluid 80 that flows in through the second inlet 4*c* (see FIG. 4) and flows out through the second outlet 4*d* (see FIG. 4). Also, the arrow 40*c* shows a change of temperature and the heat amount of the low-temperature fluid 80 that flows in through the first low-temperature side inlet 3*c* and flows out through the first low-temperature side outlet 3*d*. Also, the arrow 40*d* shows a change of temperature and the heat amount of the low-temperature fluid 80 that flows in through the second low-temperature side inlet 3*e* and flows out through the second low-temperature side outlet 3*f*.

Also, single-pointed line arrows 50*a* and 50*b* in the graph 70 show changes of temperature and the heat amount of the high-temperature fluid 81 (see FIG. 1). Specifically, the arrows 50*a* and 50*b* show changes of temperature and the heat amount of the high-temperature fluid 81 (see FIG. 1) that flows in through the high-temperature side inlet 3*a* (see FIG. 4) and flows out through the high-temperature side outlet 3*b* (see FIG. 4). Here, start points of the arrows 40*a* to 40*d*, and the arrows 50*a* and 50*b* indicate temperatures and heat amounts at heat transferring starts, and their end points indicate temperatures and heat amounts at heat transferring ends.

Also, a region R1 in the graph 70 represents heat transferring in the second heat exchanger 4 (see FIG. 4), and regions R2 and R3 represent heat transferring in the first heat exchanger 3 (see FIG. 4). Here, heat transfers of the regions R1 to R3 correspond to first to third heat transfers indicated by the circled numbers in FIG. 4, respectively.

As shown in the region R1, heat is transferred between the low-temperature fluid 80 that flows in through the first inlet 4*a* (see FIG. 4) and flows out through the first outlet 4*b* (see FIG. 4), and the low-temperature fluid 80 that flows in through the second inlet 4*c* (see FIG. 4) and flows out through the second outlet 4*d* (see FIG. 4) in the second heat exchanger 4 (see FIG. 4).

Accordingly, on one hand, the temperature of the low-temperature fluid 80 that slows in through the first inlet 4*a* and flows out through the first outlet 4*b* increases from a temperature t1 to a temperature t2 as shown by the arrow 40*a*. On the other hand, the temperature of the low-temperature fluid 80 that flows in through the second inlet 4*c* and flows out through the second outlet 4*d* decreases from a temperature t3 to a temperature t4 as shown by the arrow 40*b*.

Also, as shown in the region R2, heat is transferred between the low-temperature fluid 80 that flows in through the first low-temperature side inlet 3*c* and flows out through the first low-temperature side outlet 3*d*, and the high-temperature fluid 81 that flows in through the high-temperature side inlet 3*a* and flows out through the high-temperature side outlet 3*b* in the first heat exchanger 3 (see FIG. 4). As a result, on one hand, the temperature of the low-temperature fluid 80 that flows in through the first low-temperature side inlet 3*c* and flows out through the first low-temperature side outlet 3*d* increases from a temperature t2 to a temperature t3. On the other hand, the temperature of the high-temperature fluid 81 that flows in through the high-temperature side inlet 3*a* and flows out through the high-temperature side outlet 3*b* decreases from a temperature T1 to a temperature T2.

Here, when the temperature t1 at the start point of the arrow 40*a* is compared with the temperature t2 at the start point of the arrow 40*c*, the temperature t2 at the start point of the arrow 40*c* is higher. That is, a temperature difference td2 between the temperature t2 at the start point of the arrow 40*c* and the temperature T1 at the start point of the arrow 50*a* becomes smaller than a temperature difference td1 between the temperature t1 at the start point of the arrow 40*a* and the temperature T1 at the start point of the arrow 50*a*. For this reason, the high-temperature fluid 81 becomes unlikely to freeze as compared with a case in which the low-temperature fluid 80 is not previously heated by the second heat exchanger 4.

Also, as shown in the region R3, heat is transferred between the low-temperature fluid 80 that flows in through the second low-temperature side inlet 3*e* and flows out through the second low-temperature side outlet 3*f*, and the high-temperature fluid 81 that flows in through the high-temperature side inlet 3*a* and flows out through the high-temperature side outlet 3*b* in the first heat exchanger 3 (see FIG. 4). As a result, the temperature of the low-temperature fluid 80 that flows in through the second low-temperature side inlet 3*e* and flows out through the second low-temperature side outlet 3*f* increases from a temperature t4 to a temperature t5. Here, the temperature of the high-temperature fluid 81 that flows in through the high-temperature side inlet 3*a* and flows out through the high-temperature side outlet 3*b* decreases from the temperature T1 to the temperature T2.

Here, when the temperature t1 at the start point of the arrow 40*a* is compared with the temperature t4 at the start point of the arrow 40*d*, the temperature t4 at the start point of the arrow 40*d* is higher. That is, a temperature difference td3 between the temperature t4 at the start point of the arrow 40*d* and the temperature T1 at the start point of the arrow 50*b* becomes smaller than the temperature difference td1 between the temperature t1 at the start point of the arrow 40*a* and the temperature T1 at the start point of the arrow 50*b*. For this reason, the high-temperature fluid 81 becomes unlikely to freeze as compared with a case in which the low-temperature fluid 80 is not previously heated by the second heat exchanger 4.

Here, although the arrow 50*a* and the arrow 50*b* are separately shown in the exemplary changes shown in FIG. 5, the high-temperature flow path 2 (see FIG. 4) through which the high-temperature fluid 81 flow is not necessarily separately provided. The flow rate of the high-temperature fluid 81 that flow through the high-temperature flow path 2 can be set to a flow rate that can supply the sum of the heat amounts represented by the arrow 50*a* and the arrow 50*b*.

Here, the low-temperature fluid 80 (see FIG. 1) stored in the low-temperature fluid reservoir 7 (see FIG. 1) is gaseous hydrogen (hydrogen gas) at an ordinary temperature (temperature t5). Also, when the low-temperature fluid 80 is supplied to the to-be-supplied subject 90 (see FIG. 1), the temperature of the low-temperature fluid 80 will increase. An upper temperature limit of the low-temperature fluid 80 when supplied to the to-be-supplied subject 90 is previously defined depending on each to-be-supplied subject 90. Accordingly, the supplier 8 is configured to be able to supply the low-temperature fluid 80 at a desired temperature depending on each to-be-supplied subject 90. Specifically, the supplier 8 is configured to supply the low-temperature fluid 80 that is adjusted to a temperature different from the temperature of the low-temperature fluid 80 stored in the low-temperature fluid reservoir 7. For example, in a case in which the desired temperature is a temperature t6, the supplier 8 cools the low-temperature fluid 80 stored in the low-temperature fluid reservoir 7 at the ordinary temperature (temperature t5) to the predetermined temperature (temperature t6). Here, the ordinary temperature (temperature T5) is, for example, 10° C., and the temperature t6 is, for example, −40° C.

The supplier 8 (see FIG. 1) is configured to mix the low-temperature fluid 80 (see FIG. 1) that flows from the low-temperature fluid reservoir 7 (see FIG. 1) and the low-temperature fluid 80 that flows from the branch flow path 9 (see FIG. 1) and is lower in temperature than the low-temperature fluid 80 that is stored in the low-temperature fluid reservoir 7. Specifically, the supplier 8 is configured to adjust a flow rate of the low-temperature fluid 80 that flows in from the supply flow path 8*a* and a flow rate of the low-temperature fluid 80 that flows in from the branch flow path 9 by adjusting the first supply valve 8*b* (see FIG. 1) and the second supply valve 8*c* (see FIG. 1), and to supply the low-temperature fluid 80 at the predetermined temperature (temperature t6).

Advantages of the Embodiment

In this embodiment, the following advantages are obtained.

According to this embodiment, the low-temperature fluid 80 is heated by the second heat exchanger 4 before the low-temperature fluid 80 flows into the first heat exchanger 3 so that the low-temperature fluid 80 that flows into the first heat exchanger 3 can be previously heated. For this reason, it is possible to reduce temperature difference between the low-temperature fluid 80 that flows into the first heat exchanger 3 and the high-temperature fluid 81 as compared with a configuration including no second heat exchanger 4. Consequently, it is possible to prevent the high-temperature fluid 81 from freezing in the first heat exchanger 3.

Also, the first heat exchanger 3 serves as the heater. Accordingly, the low-temperature fluid 80 that flows out through the first outlet 4*b* can be heated by the first heat exchanger 3, and be returned through the second inlet 4*c* to the second heat exchanger 4. As a result, it is possible to heat the low-temperature fluid 80 that flows in through the second inlet 4*c* without providing a heater for heating the low-temperature fluid 80 that flows out through the first outlet 4*b*. Consequently, it is possible to reduce increase of size of the heat exchange system 100 as compared with a configuration including the heater or the like for heating the low-temperature fluid 80 that flows out through the first outlet 4*b*.

In this case, since the low-temperature fluid 80 that flows out through the first outlet 4*b* is higher in temperature than the low-temperature fluid 80 that flows in through the first inlet 4*a*, the low-temperature fluid 80 that flows out through the second outlet 4*d* becomes higher in temperature than the low-temperature fluid 80 that flows in through the first inlet 4*a*. That is, both the low-temperature fluid 80 that flows out through the first outlet 4*b* and flows into the first heat exchanger 3, and the low-temperature fluid 80 that flows in through the second outlet 4*d* and flows into the first heat exchanger 3 flow into the first heat exchanger 3 with their temperatures being higher than the low-temperature fluid 80 that flows into the first heat exchanger through the first inlet 4*a*. Accordingly, temperature difference between the low-temperature fluid 80 and the high-temperature fluid 81 can be reduced as compared with a configuration in which the low-temperature fluid 80 directly flows into the first heat exchanger 3 without flowing in the second heat exchanger 4. Consequently, it is possible to prevent the high-temperature fluid 81 from freezing as compared with the configuration in which the low-temperature fluid 80 directly flows into the first heat exchanger 3 without flowing in the second heat exchanger 4.

Also, the first heat exchanger 3 further includes the second low-temperature side inlet 3*e*, which communicates with the second outlet 4*d* of the second heat exchanger 4, and the second low-temperature side outlet 3*f* which communicates with the second low-temperature side inlet 3*e*; and the low-temperature fluid 80 that flows out of the second heat exchanger through the second outlet 4*d* of the second heat exchanger 4 flows into the first heat exchanger 3 through the second low-temperature side inlet 3*e* of the first heat exchanger 3 and transfers heat from the high-temperature fluid 81. Accordingly, since the first low-temperature side outlet 3*e* of the first heat exchanger 3 communicates with the second inlet 4*d* of the second heat exchanger 4, it is possible to easily flow the low-temperature fluid 80 whose heat has been transferred in the second heat exchanger 4 into the first heat exchanger 3. Consequently, it is possible to easily form a fluid circuit capable of flowing the low-temperature fluid 80 into the first heat exchanger 3 with the low-temperature fluid being previously heated by the second heat exchanger 4.

Also, the first heat exchanger 3 is configured to transfer heat between the high-temperature fluid 81 in the high-temperature flow path 2 and the low-temperature fluid 80 flowing into the first heat exchanger through the first low-temperature side inlet 3*c* of the first heat exchanger 3, and to transfer heat between the high-temperature fluid 81 in the high-temperature flow path 2 and the low-temperature fluid 80 flowing into the first heat exchanger through the second low-temperature side inlet 3*e* of the first heat exchanger 3. Accordingly, the first heat exchanger 3 can transfer heat between three flows of the high-temperature fluid 81, the low-temperature fluid 80 that flows in through the first low-temperature side inlet 3*c*, and the low-temperature fluid 80 that flows in through the second low-temperature side inlet 3*e*. Consequently, it is possible to prevent increase of the number of parts and a complicated structure as compared with a configuration which separately includes a heat exchanger that transfers heat between the high-temperature fluid 81 and the low-temperature fluid 80 that flows in through the first low-temperature side inlet 3*c*, and a heat exchanger that transfers heat between the high-temperature fluid 81 and the low-temperature fluid 80 that flows in through the second low-temperature side inlet 3*e*.

Also, the first heat exchanger 3 and the second heat exchanger 4 are provided in the first heat exchange unit 10 and the second heat exchange unit 20 which are different from each other, respectively. Accordingly, a fluid circuit capable of previously heating the low-temperature fluid 80 that flows into the first heat exchanger 3 to increase temperature the low-temperature fluid by using the second heat exchanger 4 can be easily formed by connecting the first heat exchange unit 10 including the first heat exchanger 3 and the second heat exchange unit 20 including the second heat exchanger 4 to each other. Consequently, it is possible to prevent installation of pipes of the heat exchangers from becoming complicated as compared with a heat exchange unit including both the first heat exchanger 3 and the second heat exchanger 4, for example.

Also, the low-temperature fluid tank 5 for storing the liquid low-temperature fluid 80; the low-temperature fluid reservoir 7 for reserving the low-temperature fluid 80 that is heated and is vaporized by the first heat exchanger 3; the low-temperature fluid pump 6 for flowing the low-temperature fluid 80 stored in the low-temperature fluid tank 5 through the low-temperature flow path 1; the supplier 8 connected to the low-temperature fluid reservoir 7 to supply the vaporized low-temperature fluid 80 to the to-be-supplied subject 90; and the branch flow path 9 branched from the low-temperature flow path 1 and connected to the supplier 8 to flow the low-temperature fluid 80 through the branch flow path are provided, and the supplier 8 is configured to mix the low-temperature fluid 80 flowing in from the low-temperature fluid reservoir 7 and the low-temperature fluid 80 flowing in from the branch flow path 9 and is lower in temperature than the low-temperature fluid 80 that is stored in the low-temperature fluid reservoir 7. Accordingly, in a case in which the low-temperature fluid 80 which is stored in the low-temperature fluid reservoir 7 and whose temperature is reduced is supplied to the to-be-supplied subject 90, the temperature of the low-temperature fluid 80 can be easily reduced by mixing the low-temperature fluid 80 that is stored in the low-temperature fluid reservoir 7 with the low-temperature fluid 80 that flows from the branch flow path 9. Accordingly, the temperature of the low-temperature fluid 80 that is stored in the reservoir can be reduced to a temperature when supplied to the supplied subject without using a refrigerator, or the like. Consequently, it is possible to prevent the system from becoming large as compared to a configuration including such a refrigerator for reducing the temperature of the low-temperature fluid 80 that is stored in the low-temperature fluid reservoir 7, for example.

Also, the low-temperature fluid 80 is liquid hydrogen, and the high-temperature fluid 81 is warm water. Accordingly, it is possible to provide a heat exchange system capable 100 of preventing, when transferring heat between liquid hydrogen as the low-temperature fluid 80 and warm water as the high-temperature fluid 81, the warm water from freezing.

Modified Embodiments

Figure 6:
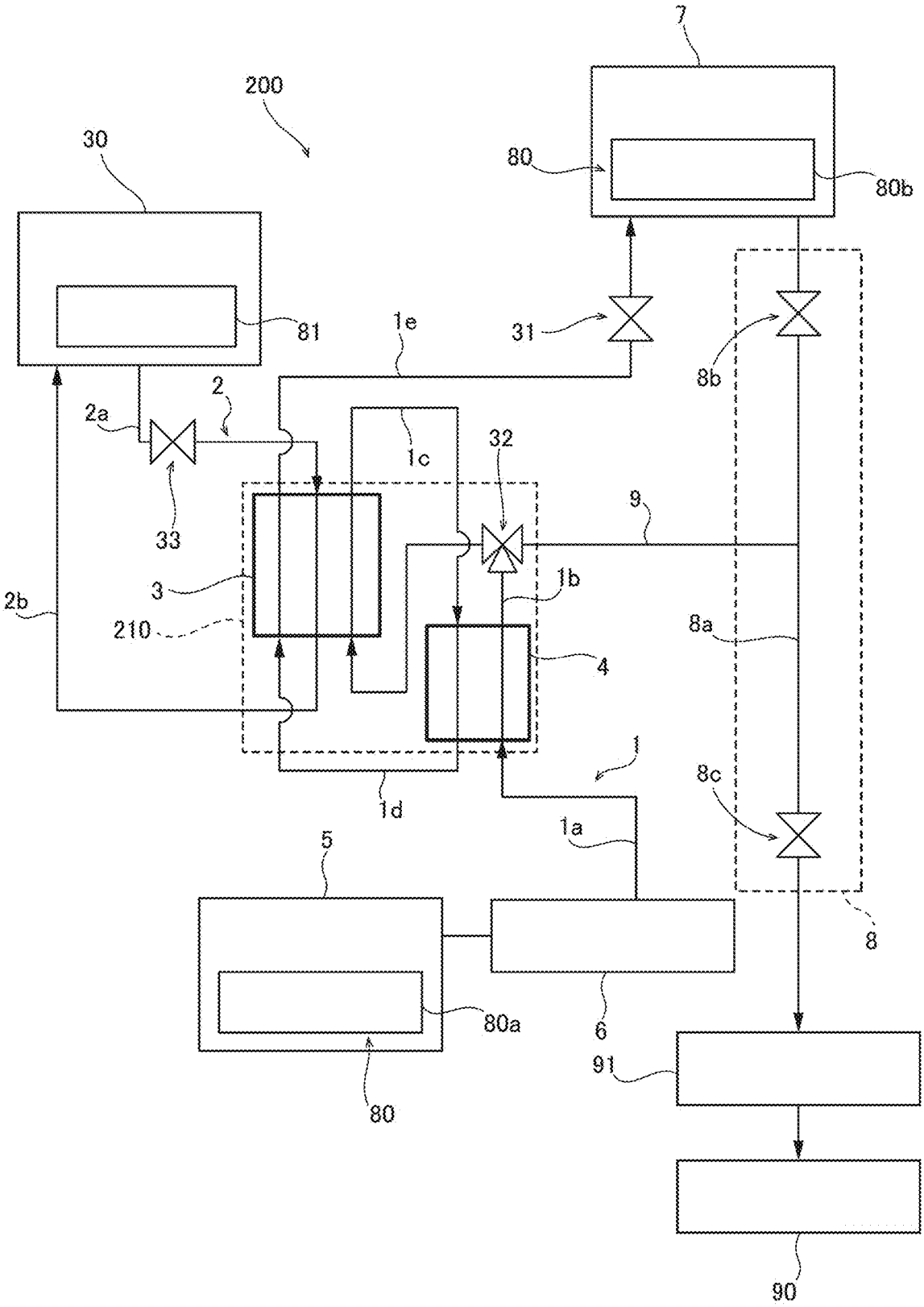
FIG. 6 is a diagram showing an entire configuration of a heat exchange system according to one modified example of the embodiment.

For example, the first heat exchanger 3 and the second heat exchanger 4 can be provided in a single heat exchange unit 210 as shown in FIG. 6.

The heat exchange system may be configured to increase pressure of the low-temperature fluid 80 that is vaporized by the first heat exchanger 3 and the second heat exchanger 4 to a predetermined pressure and to store the low-temperature fluid with the increased pressure in the low-temperature fluid reservoir 7.

For example, the low-temperature fluid 80 that flows out through the first outlet 4*b* and flows in through the second inlet 4*c* may not be heated by the first heat exchanger 3 (heater). In this case, a heating device such as a heater can be provided at a position on the low-temperature flow path 1 between the first outlet 4*b* and the second inlet 4*c*, and be configured to heat the low-temperature fluid 80. Also, the low-temperature fluid 80 that flows in through the second inlet 4*c* may be heated to a predetermined temperature by transferring heat between the low-temperature fluid 80 and air after the low-temperature fluid flows out through the first outlet 4*b* until the low-temperature fluid flows in through the second inlet 4*c*. In this case, the first outlet 4*b* and the second inlet 4*c* can be connected to each other by the low-temperature flow path 1 that has a length (flow path length) that can heat the low-temperature fluid 80 by air to the predetermined temperature. However, in a case in which the heating device such as a heater is provided between the first outlet 4*b* and the second inlet 4*c*, the system becomes large. In addition, in a configuration in which heat is transferred between the low-temperature fluid 80 and air, the length (flow path length) of the low-temperature flow path 1 between the first outlet 4*b* and the second inlet 4*c* is increased so that the system becomes large. For this reason, the first heat exchanger 3 is preferably configured to serve as the heater.

If the temperature of the low-temperature fluid 80 that flows out through the second outlet 4*d* is higher than the temperature of the low-temperature fluid 80 that flows in through the first inlet 4*a*, it may be higher or lower than the temperature of the low-temperature fluid 80 that flows out through the first outlet 4*b*.

Also, the first heat exchanger 3 may include neither the second low-temperature side inlet 3*e* nor the second low-temperature side outlet 3*f*. In this case, a heat exchange unit for transferring heat between the low-temperature fluid 80 that flows out through the second outlet 4*d* and the high-temperature fluid 81 can be separately provided. However, in the aforementioned configuration, the system becomes large. For this reason, the first heat exchanger 3 preferably includes the second low-temperature side inlet 3*e* and the second low-temperature side outlet 3*f*.

The heat exchange system 100 may include no low-temperature fluid reservoir 7 if the heat exchange system 100 includes the low-temperature fluid pump 6 capable of supplying the to-be-supplied subject 90 with a predetermined supply amount of the low-temperature fluid 80.

The low-temperature fluid 80 may be liquid helium or liquefied natural gas. Also, the high-temperature fluid 81 may be ethylene glycol.

The first heat exchanger 3 and the second heat exchanger 4 may be any type of heat exchangers. The first heat exchanger 3 and the second heat exchanger 4 may be diffusion-bonded type heat exchangers in which a plurality of heat transfer plates having grooved flow paths formed thereon are bonded by diffusion phenomenon, for example.

The branch flow path 9 may branch from any point on the low-temperature flow path 1 as long as temperature of the low-temperature fluid 80 that is branched to the branch flow path is lower than the low-temperature fluid 80 that is stored in the low-temperature fluid reservoir 7. In other words, the branch flow path 9 may branch from any point on the low-temperature flow path 1 except the fifth low-temperature flow path part 1*e*.

DESCRIPTION OF REFERENCE NUMERALS

1; low-temperature flow path
2; high-temperature flow path
3; first heat exchanger (heater)
3*c*; first low-temperature side inlet
3*d*; first low-temperature side outlet
3*e*; second low-temperature side inlet
3*f*; second low-temperature side outlet
4; second heat exchanger
4*a*; first inlet
4*b*; first outlet
4*c*; second inlet
4*d*; second outlet
5; low-temperature fluid tank
6; low-temperature fluid pump
7; low-temperature fluid reservoir
8; supplier
9; branch flow path
10; first heat exchange unit
20; second heat exchange unit
80; low-temperature fluid
81; high-temperature fluid
90; to-be-supplied subject
100, 200; heat exchange system

What is claimed is:

1. A heat exchange system comprising:

a first heat exchanger for transferring heat between a low-temperature fluid and a high-temperature fluid whose temperature is higher than the low-temperature fluid;

a second heat exchanger for transferring heat between flows of the low-temperature fluid;

a low-temperature flow path through which a low-temperature fluid flows;

a supplier for supplying the vaporized low-temperature fluid to a to-be-supplied subject; and a branch flow path branched from the low-temperature flow path and connected to the supplier to flow the low-temperature fluid, the second heat exchanger including:

a first inlet configured for the low-temperature fluid to flow into;

a first outlet which communicates with the first inlet;

a second inlet configured for the low-temperature fluid to flow into; and a second outlet which communicates with the second inlet, wherein the second heat exchanger is configured to transfer heat between the low-temperature fluid flowing in from the first inlet and the low-temperature fluid flowing out from the first outlet and flowing in from the second inlet, the first heat exchanger is provided between the first outlet and the second inlet and is configured to heat the low-temperature fluid flowing out from the first outlet, the low-temperature fluid flowing out from the second outlet can flow into the first exchanger, the supplier is configured to mix the vaporized low-temperature fluid and the low-temperature fluid that flows from the branch flow path and is lower in temperature than the vaporized low-temperature fluid.

2. The heat exchange system according to claim 1, wherein the first heat exchanger including:

a first low-temperature side inlet configured for the low-temperature fluid to flow into; and a first low-temperature side outlet which communicates with the first low-temperature side inlet, the first outlet communicates with the first low-temperature side inlet, the low-temperature fluid flowing out from the first outlet can flow into the first low-temperature side inlet, flow out from the first low-temperature side outlet, and flow into the second inlet.

3. The heat exchange system according to claim 2, wherein the first heat exchanger further including:

a second low-temperature side inlet which communicates with the second outlet; and a second low-temperature side outlet which communicates with the second low-temperature side inlet, the low-temperature fluid flowing out from the second outlet can flow into the second low-temperature side inlet.

4. The heat exchange system according to claim 3, wherein the first heat exchanger is configured to transfer heat between the high-temperature fluid and the low-temperature fluid flowing into the first heat exchanger through the first low-temperature side inlet, and to transfer heat between the high-temperature fluid and the low-temperature fluid flowing into the first heat exchanger through the second low-temperature side inlet.

5. The heat exchange system according to claim 3 further comprising:

a first heat exchange unit; and a second heat exchange unit, wherein the first heat exchanger is provided in one of the first heat unit and the second heat unit, the second heat exchanger is provided in another one of the first heat unit and the second heat unit.

6. The heat exchange system according to claim 5 further comprising:

a low-temperature fluid tank for storing the liquid low-temperature fluid;

a low-temperature fluid pump for flowing the low-temperature fluid stored in the low-temperature fluid tank through the low-temperature flow path; and a low-temperature fluid reservoir for reserving the low-temperature fluid flowing out from the first heat exchanger;

wherein the supplier is configured to mix the low-temperature fluid flowing in from the low-temperature fluid reservoir and the low-temperature fluid flowing in from the branch flow path.

7. The heat exchange system according to claim 6, wherein the low-temperature fluid flowing in from the branch flow path is lower in temperature than the low-temperature fluid that is stored in the low-temperature fluid reservoir.

8. The heat exchange system according to claim 1, wherein the low-temperature fluid is liquid hydrogen, the high-temperature fluid is warm water.

* * * * *